US005364283A

United States Patent [19]

Katoh et al.

[11] Patent Number: 5,364,283

[45] Date of Patent: Nov. 15, 1994

[54] CONNECTING DEVICE

[75] Inventors: Kiyokazu Katoh, Nagoya; Kenichi Kaneko, Kariya; Osamu Matsubara, Anjo; Takashi Niwa, Nishikamo, all of Japan

[73] Assignee: Aisin Seiki Kabushiki Kaisha, Kariya, Japan

[21] Appl. No.: 38,866

[22] Filed: Mar. 29, 1993

[30] Foreign Application Priority Data

Mar. 30, 1992 [JP] Japan ..... 4-074422

[51] Int. Cl.[5] ..... H01R 4/60

[52] U.S. Cl. ..... 439/201; 439/936

[58] Field of Search ..... 439/190, 191, 201, 204, 439/936

[56] References Cited

U.S. PATENT DOCUMENTS

| | | | |
|---|---|---|---|
| 3,504,099 | 3/1970 | Beinhaur | 439/204 X |
| 3,522,576 | 8/1970 | Cairns | 439/201 |
| 4,085,993 | 4/1978 | Cairns | 439/201 |
| 4,696,540 | 9/1987 | Adams et al. | 439/201 X |
| 4,998,894 | 3/1991 | Gronvall . | |
| 5,007,852 | 4/1991 | Dean et al. | 439/201 |

FOREIGN PATENT DOCUMENTS

| | | | |
|---|---|---|---|
| 2230670 | 9/1990 | Japan . | |
| 1379525 | 1/1975 | United Kingdom | 439/201 |
| 1536541 | 12/1978 | United Kingdom . | |

*Primary Examiner*—Khiem Nguyen

*Attorney, Agent, or Firm*—Oblon, Spivak, McClelland, Maier & Neustadt

[57] ABSTRACT

A connecting device is comprised of a first housing having therein a pair of parallely spaced first passages each of which has a proximal end and a distal end, a male terminal accommodated in each of the first passages and having a proximal end to which a first wire is connected and a distal end, a second housing having therein a pair of parallely spaced second passages each of which has a proximal end and a distal end fitted into the distal end of the corresponding first passage, a female terminal accommodated in each of the second passages, having a proximal end to which a second wire is connected and a distal end engaged with the distal end of the corresponding male terminal, and an amount of viscous oily substance positioned in the neighbourhood of a portion at which the distal end of the male terminal and the distal end of the female terminal are in engagement with each other in such a manner of an establishment of conductivity therebetween.

4 Claims, 4 Drawing Sheets

CONNECTING DEVICE

BACKGROUND OF THE INVENTION

The present invention relates to a connecting device and in particular to a connecting device by which an electric device is electrically connected to another electric device.

A conventional connecting device which is shown in FIG. 13 includes a first housing 2 having a pair of parallely spaced male terminals 1 (only one is shown), and a second housing 4 having a pair of parallely spaced female terminals 3 (only one is shown). The first housing 2 is detachably coupled to the second housing 4 in such a manner that each of the male terminals 1 is fitted in the corresponding female terminal 3. The first housing 2 is provided therein with a pair of parallely spaced passages 2*a* (only one is shown) in which the male terminals 1 are secured. Similarly, the second housing 4 is provided therein a pair of parallely spaced passages 4*a* (only one is shown) in which the female terminals 3 are secured. Each of the passage 2*a* and each of the passage 4*a* are extended throughout the first housing 2 and the second housing 4, respectively.

The foregoing connecting device sometimes may not be used in specific facilities or equipment. In particular, a unit bath room which is so constructed as to install a bath tub and a sanitary device in a common container or unit is becoming widely used. When, as the sanitary device, an electrically operated sanitary device is used which has a toilet bowl and an electrically operated washing apparatus for the washing of a portion (the anus and/or the crotch), the connecting device employed in the electrically operated washing apparatus should be protected from high humidity within the container or unit bath room. The reason is that the high humidity will bring condensation in the neighbourhood of each of the housing 2 and 4, which may be the cause of poor insulation, short circuit or electric leakage. In the light of the current reliability of the conventional connecting device, no conventional connecting device is qualified for being employed in the foregoing sanitary device. Thus, at present, the the sanitary device which is commercially available to be installed in the unit bath room is not provided with the electrically operated washing apparatus. In order to make the conventional connecting device to increase the reliability thereof against humidity, synthetic resin may be supplied into the passages 2*a* and 4*a* for the prevention of condensation in the housings 2 and 4. Such an idea, though it is excellent in a sense, is impractical due to the fact that one of the housing then can't be separated from the other housing.

SUMMARY OF THE INVENTION

It is, therefore, a principal object of the present invention is to provide a humidity-proof connecting device in which two housing are detachable from each other.

Another object of tile present invention is to provide a humidity-proof connecting device in which a conductive grease is used for the humidity-proof, thereby enabling the two housing to be detachable from each other.

A further object of the present invention is to provide a humidity-proof connecting device in which a conductive grease is used for the humidity-proof to thereby enable that the two housing are detachable each other, and in which the conductive grease is protected by a sealing means.

A still further object of the present invention is to provide a humidity-proof connecting device in which a conductive grease is used for the humidity-proof to thereby enabling that two housing are detachable from each other, and in which the conductive grease is protected from deterioration by a sealing member.

In order to attain the foregoing objects, a connecting device is comprised of a first housing having therein a pair of parallely spaced first passages each of which has a proximal end and a distal end, a male terminal accommodated in each of the first passages and having a proximal end to which a first wire is connected and a distal end, a second housing having therein a pair of parallely spaced second passages each of which has a proximal end and a distal end fitted into the distal end of the corresponding First passage, a female terminal accommodated in each of the second passages, having a proximal end to which a second wire is connected and a distal end engaged with the distal end of the corresponding male terminal, and an amount of viscous oily substance is positioned in the neighbourhood of a portion at which the distal end of the male terminal and the distal end of the female terminal are in engagement with each other in such a manner establish conductivity therebetween.

BRIEF DESCRIPTION OF THE DRAWINGS

The above and other objects, features and advantages of the present invention will be more apparent and more readily appreciated from the following detailed description of preferred exemplarily embodiment of the present invention, taken in connection with the accompanying drawings, in which.

DESCRIPTION OF THE PREFERRED EMBODIMENTS

Preferred embodiments of the present invention will be described hereinunder in detail with reference to the accompanying drawings.

Figure 1A:
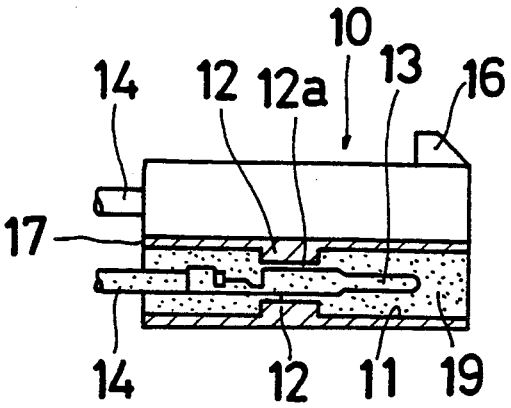
FIG. 1 is a cross-sectional view of a first embodiment of a connecting device according to the present invention which is in its separated condition.
Figure 1B:
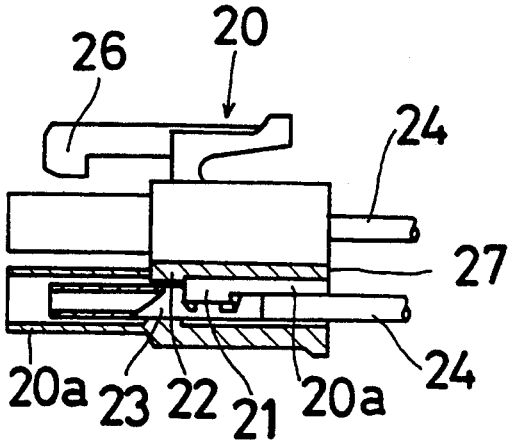
Figure 2:
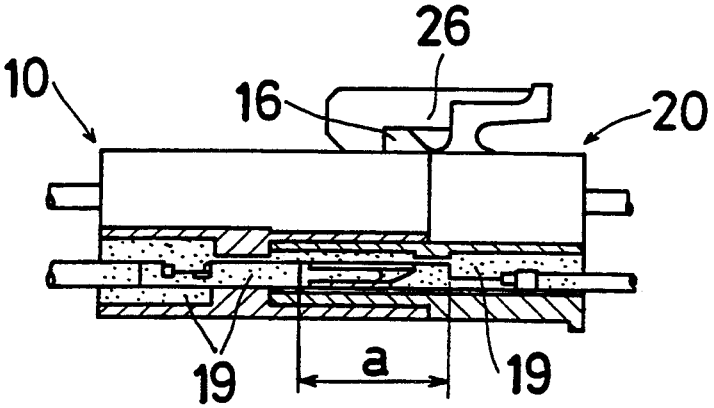
FIG. 2 is a cross-sectional view of a first embodiment of a connecting device according to the present invention which is in its coupled condition.

Referring first to FIGS. 1 and 2, a connecting device includes a first housing 10 and a second housing 20. A pair of parallely spaced passages 11 (only one is shown) are so formed in the first housing 10 as to pass therethrough. The passage 11 is provided with an inner projecting holding portion 12 to which a male terminal 13 is secured. Between the male terminal 13 and the holding portion 12, there is defined a gap or clearance 12*a* by which the passage 11 remains its open condition. The male terminal 13 is connected at its left end 17 with a wire 14. A convex portion 16 is formed on the first housing 10 which is to be interlocked with an engaging portion 26 of the second housing 20.

Similar to the first housing 10, the second housing 20 includes a pair of parallely spaced passages 22 (only one is shown) which are so formed in the second housing 20 as to pass therethrough. The second housing 20 is provide with a pair of parallely spaced cylinder portions 20*a*. A second passage 21 is so provided in each of the cylinder portions 20*a* as to pass therethrough. At an inner projecting holding portion 22 of the second passage 21, there is secured a female terminal 23 which is connected at its right end with a wire 24. The outer radius of each of the cylinder portions 20*a* is identical to the inner radius of each of the first passages 11, which enables a male-female connection or coupling therebetween. Once such coupling is established, the resultant coupling is kept by the interlocking connection between the convex portion 16 of the first housing 10 and the engaging portion 26 of the second housing 20.

Within the first passage 11, an amount of viscous oily insulation grease 19 is filled. As the grease 19, one is used which is supplied, by name of "Multtemp CE-T No.2", by Kyodo Yushi Co.,Ltd in Japan. Thus, when the cylinder portion 20*a* of the second housing 20 is inserted into the first passage 11 for the connection of the first housing 10 with the second housing 20 which will bring the connection between the male terminal 13 and the female terminal 23, as best shown in FIG. 2, the grease 19 in the first passage 11 is displaced or moved into the second passage 21, which leads to that the male terminal 13 and the female terminal 23 are entirely covered with the grease 19. The grease 19, though it is insulating per se, is of a character that its oil thin film is apt to disappear when a pressure is applied thereto. Thus, the male terminal 13 and the female terminal 23 are shielded from the atmosphere, whereby each of the male terminal 13 and the female terminal 23 becomes water-proof. The grease 19 in the form of a oil thin film between the the male terminal 13 and the female terminal 23 is under a pressure therebetween, which results in that the insulation function of the grease 19 disappears therebetween due to disappearance of the oil thin film. Thus, the conductivity between the male terminal 13 and the female terminal 23 is assured. In the light of the fact that grease fails to solidify, the first housing 10 can be removed from the second housing 20 after the connection therebetween. So long as the grease exists in the passage, the connection and removal of the first housing 10 relative to the second housing 20 can be repeated.

Figure 3A:
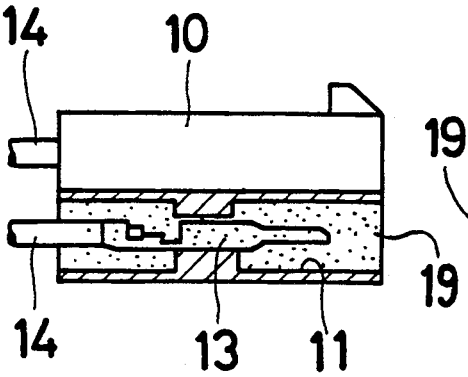
FIG. 3 is a cross-sectional view of a second embodiment of a connecting device according to the present invention which is in its separated condition.
Figure 3B:
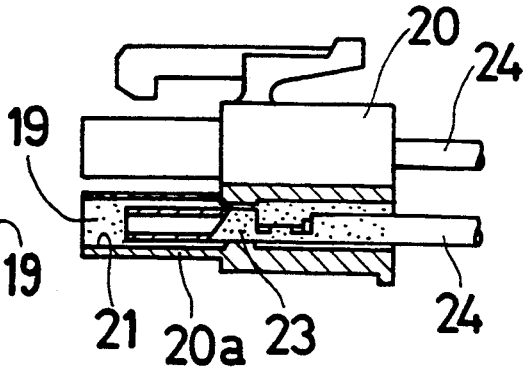

As shown in FIG. 3, the grease is filled in the second passage 21 as well as the first passage 11. Thus, upon connection between the first housing 10 and the second housing 20, the male terminal 13 and the female terminal 23 are entirely covered with the grease 19, with the results in higher water-proofing.

Figure 4A:
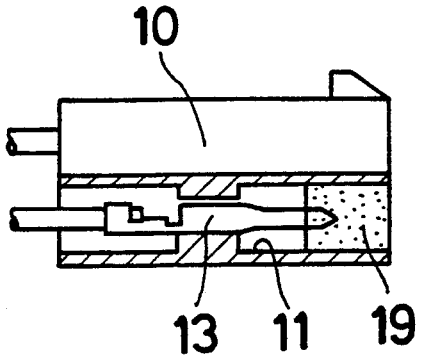
FIG. 4 is a cross-sectional view of a third embodiment of a connecting device according to the present invention which is in its separated condition.
Figure 4B:
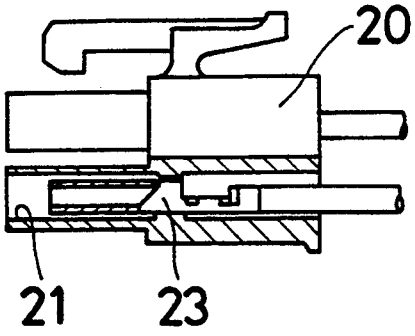
Figure 5:
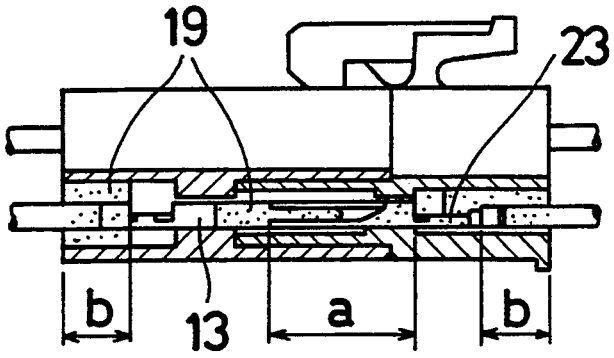
FIG. 5 is a cross-sectional view of a third embodiment of a connecting device according to the present invention which is in its connected condition.

As shown in FIG. 4, before coupling, the grease is filled in the neighbourhood of the male terminal 13. After coupling, as shown in FIG. 5, each of the left end of the first passage 11 and the right end of the second passage 21 are closed by the grease 19. The amount of grease 19 can be decreased in comparison with the previously disclosed embodiments.

Figure 6A:
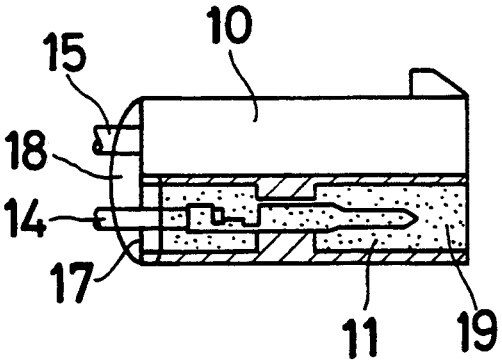
FIG. 6 is a cross-sectional view of a fourth embodiment of a connecting device according to the present invention which is in its separated condition.
Figure 6B:
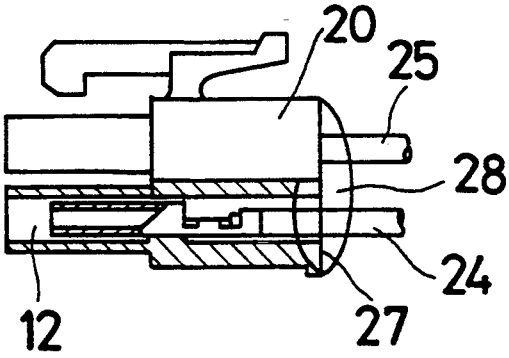
Figure 7:
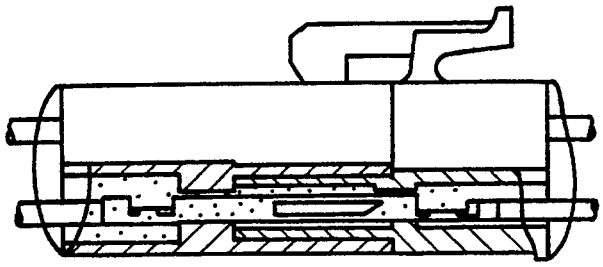
FIG. 7 is a cross-sectional view of a fourth embodiment of connecting device according to the present invention which is in its connected condition.
Figure 8A:
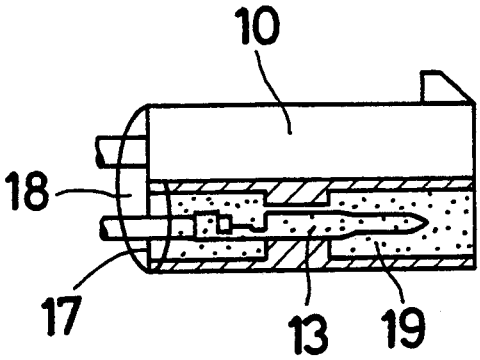
FIG. 8 is a cross-sectional view of a fifth embodiment of a connecting device according to the present invention which is in its separated condition.
Figure 8B:
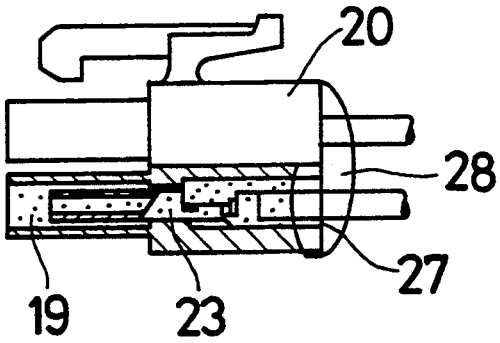

In FIG. 6, the grease 19 is filled in the first passage 11 left end is closed by a silicon cover 18. After coupling of the first housing 10 with the second housing 20 in which the right end of the second passage 23 is closed by a silicon cover 28. Thus, the grease 19 in the passages 11 and 21 are shielded from the atmosphere. This ensures the long-range prevention of an invasion of water into each housing and the holding of the wire 14 (24) to the housing 10 (20). It is to be noted that as shown in FIG. 8 the grease 19 can be filled in both passages 11 and 21 before coupling.

Figure 9A:
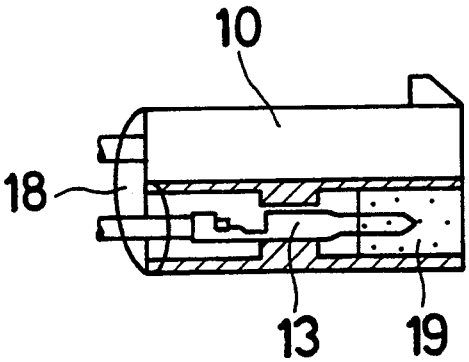
FIG. 9 is a cross-sectional view of a sixth embodiment of a connecting device according to the present invention which is in its separated condition.
Figure 9B:
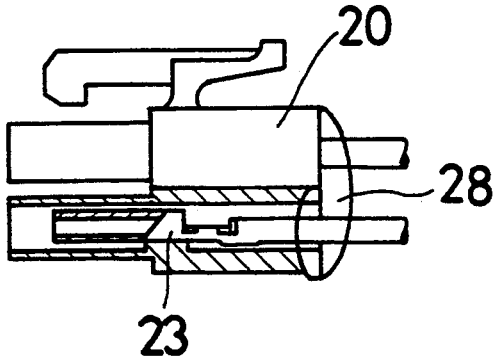
Figure 10:
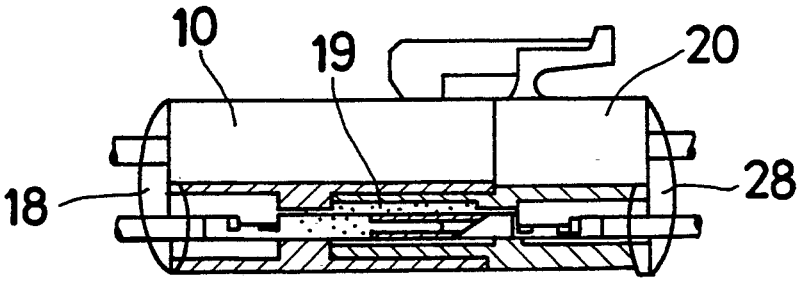
FIG. 10 is a cross-sectional view of a sixth embodiment of a connecting device according to the present invention which is in its connected condition.
Figure 11A:
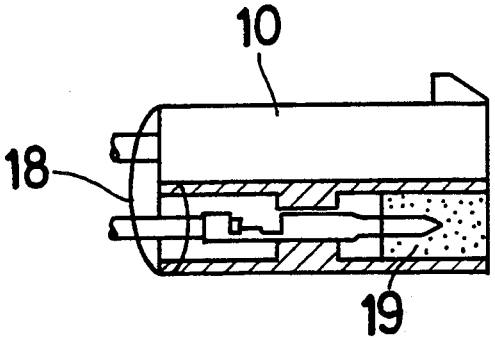
FIG. 11 is a cross-sectional view of a seventh embodiment of a connecting device according to the present invention which is in its separated condition.
Figure 11B:
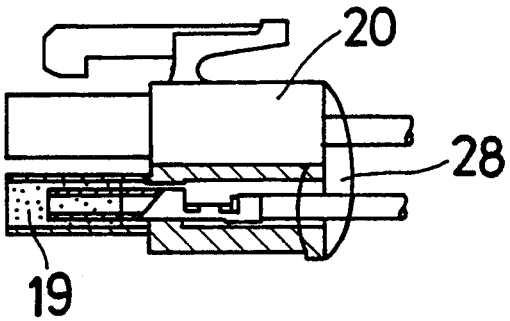
Figure 12A:
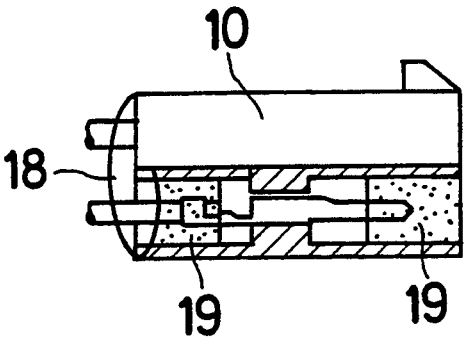
FIG. 12 is a cross-sectional view of a eighth embodiment of a connecting device according to the present invention which is in its separated condition.
Figure 12B:
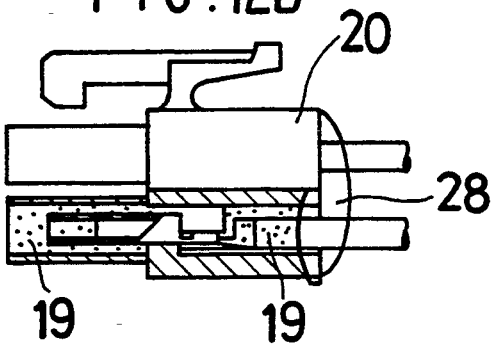
Figure 13:
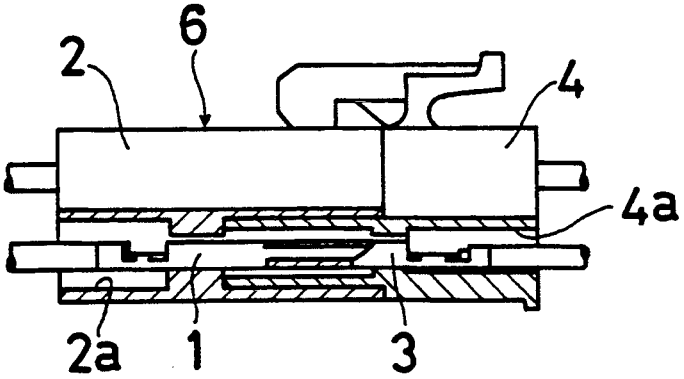
FIG. 13 PRIOR ART
FIG. 13 is a cross-sectional view of a conventional connecting device.

In FIG. 9, the first passage 11 is provided at its right end and left end with the grease 19 and the silicon cover 18. When the first housing 10 which is of such structure is brought into coupling with the second housing 20 in which the second passage 21 is closed at its right end by the silicon 28, the structure shown in FIG. 10 is established. In addition to the structure in FIG. 9, as shown in FIG. 11, the grease 19 can be filled in the left end of the second passage 21. Moreover, the grease 19 can be filled at both ends of the first passage 11 (the second passage 21) which is closed at its left end (right end) by the silicon 18(28).

The invention has thus been shown and described with reference to reference to specific embodiments, however, it should be noted that the invention is in no way limited to the details of the illustrated structures but changes and modifications may be made without departing from the scope of the appended claims.

What is claimed is:

1. A connecting device comprising:

a first housing having therein a pair of parallely spaced first passages each of which has a proximal end and a distal end;

a male terminal accommodated in each of the first passages and having a proximal end to which a first wire is connected and a distal end, said first housing and each male terminal forming a first clearance therebetween to provide communication between said distal end and said proximal end;

a second housing having therein a pair of parallely spaced second passages each of which has a proximal end and a distal end fitted into the distal end of the corresponding first passage;

a female terminal accommodated in each of the second passages, having a proximal end to which a second wire is connected and a distal end engageable with the distal end of the corresponding male terminal, said second housing and each said female terminal forming a second clearance therebetween to provide communication between said distal end and said proximal end;

an amount of viscous oily substance positioned in at least one of said housings adjacent the distal end of the terminal therein, said amount of viscous oily substance not insulating at least one of said proximal ends before said distal ends of said male and female terminals are engaged, said amount of viscous oily substance being sufficient that said viscous oil substance is forced through said at least one of said first and second clearances so as to insulate the relevant proximal end when said distal ends of said male and female terminals are engaged.

2. A connecting device in accordance with claim 1, wherein the viscous oily substance is a grease which is of the characteristics that its oil thin film is apt to be disappeared upon application of pressure thereto.

3. A connecting device in accordance with claim 1 further comprising a sealing substance closing the distal ends of the first passages and the second passages.

4. A connecting device in accordance with claim 3, wherein the sealing substance is a silicon.

* * * * *